US005765809A

United States Patent [19]

Baker et al.

[11] Patent Number: 5,765,809

[45] Date of Patent: Jun. 16, 1998

[54] DEVICE FOR LIFTING HEAVY ITEMS

[75] Inventors: Jeffrey A. Baker, Middlebourn, W. Va.; Dale R. Trembly, Hannibal, Ohio

[73] Assignee: Bayer Corporation, Pittsburgh, Pa.

[21] Appl. No.: 654,470

[22] Filed: May 28, 1996

[51] Int. Cl.[6] ..... B66D 1/00

[52] U.S. Cl. ..... 254/335; 212/252

[58] Field of Search ..... 254/332, 334, 254/335, 338; 212/250, 252, 347, 348

[56] References Cited

U.S. PATENT DOCUMENTS

| | | | |
|---|---|---|---|
| 124,878 | 3/1872 | Blood . | |
| 894,923 | 8/1908 | Vicksell . | |
| 1,509,800 | 9/1924 | Vogel | 212/252 |
| 1,584,117 | 5/1926 | Mitchell . | |
| 1,774,996 | 9/1930 | Rohrmann et al. | 212/252 |
| 1,861,191 | 5/1932 | Russell . | |
| 2,419,145 | 4/1947 | Kersenbrock et al. | 214/95 |
| 2,517,085 | 8/1950 | Cirillo | 212/252 |
| 3,337,187 | 8/1967 | Sumner | 254/143 |
| 3,432,145 | 3/1969 | Mudge | 212/252 |
| 3,899,089 | 8/1975 | Wardlaw | 214/75 H |
| 4,419,038 | 12/1983 | Pendergraft | 414/543 |
| 4,706,939 | 11/1987 | Gagne | 254/332 |
| 4,770,304 | 9/1988 | Woods | 212/348 |
| 5,090,580 | 2/1992 | Nelson | 212/252 |
| 5,240,229 | 8/1993 | Timmons | 254/335 |

*Primary Examiner*—Katherine Matecki

*Attorney, Agent, or Firm*—Joseph C. Gil; Noland J. Cheung

[57] ABSTRACT

The present invention is directed to a device for lifting heavy items from machinery in confined areas. The device of the invention can be easily mounted on a particular piece of equipment and allows for the easy removal of the part or item to be repaired or replaced. Because of its relatively small size, the device can be readily used in confined areas.

2 Claims, 2 Drawing Sheets

DEVICE FOR LIFTING HEAVY ITEMS

BACKGROUND OF THE INVENTION

In present day chemical production plants, heavy parts or items (such as pumps) must be removed from machinery from time-to-time and either be replaced or repaired. Typically, these items are located in confined areas which have limited room for movement. A need has thus arisen for a device which can be used in confined areas and which makes the removal and replacement of such items or parts relatively simple. Portable lifting devices are known (see, e.g., U.S. Pat. Nos. 124,878, 894,923, 1,584,117, 1,861,191, 2,419,145, 3,337,187, 3,899,089, and 4,419,038).

DESCRIPTION OF THE INVENTION

Figure 1:
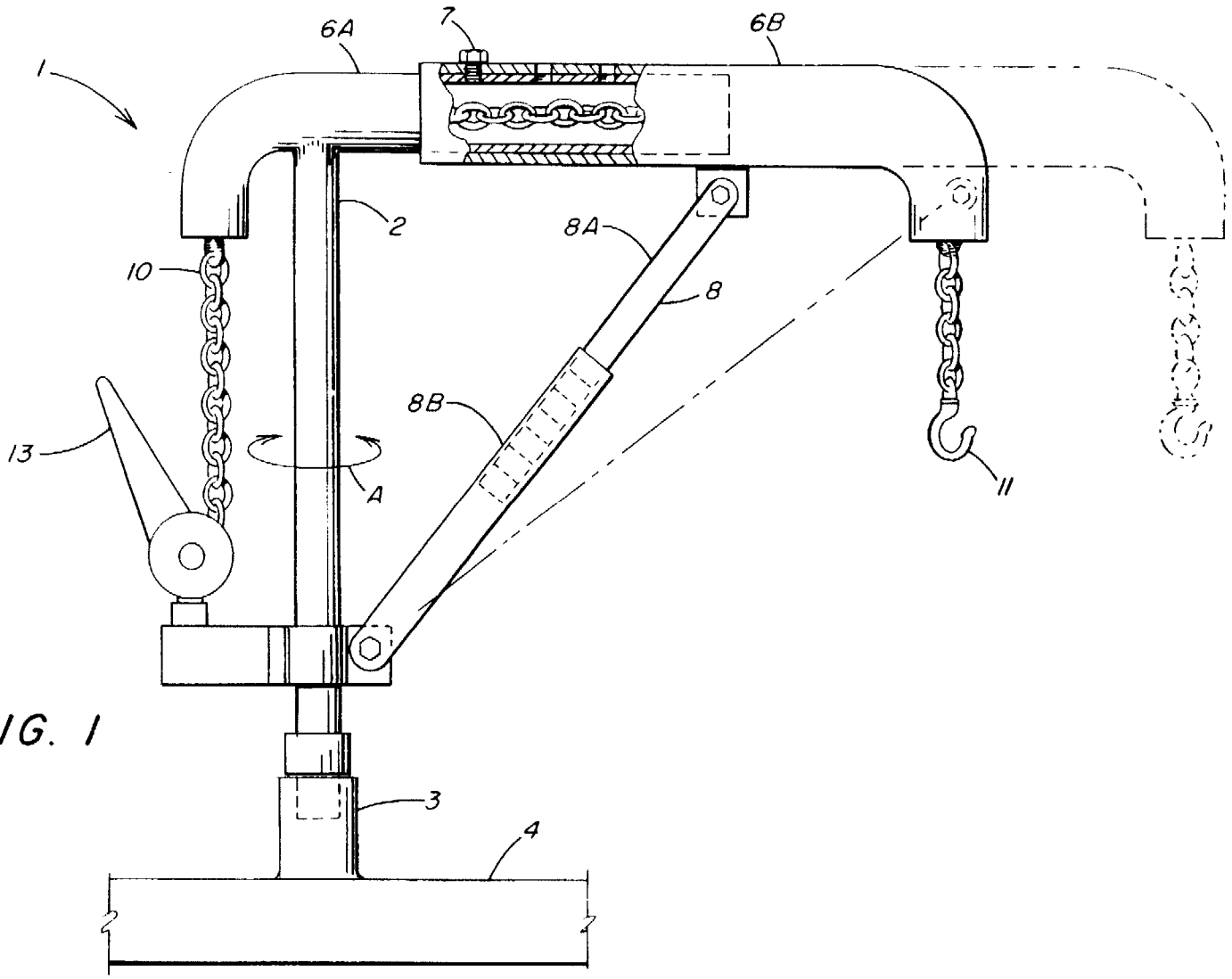
FIG. 1 shows the device of the present invention.

The present invention is directed to a device for lifting heavy items from machinery in confined areas comprising:

a) a rigid vertical piece, one end of which is adapted to fit into a receiver attached to said machinery, said receiver capable of holding said vertical piece in vertical alignment and of allowing said vertical piece to rotate, and the other end of said piece attached to b) a generally horizontal, hollow pipe, said pipe being curved downwardly at both ends, c) a brace supporting said pipe, said brace connected to said pipe and to said vertical piece, and d) a chain running through said pipe, said chain having a hook at one end and a ratcheting device at the other end, said ratcheting device being used to generate the force necessary to lift said heavy items.

The device of the invention can be easily mounted on a particular piece of equipment and allows for the easy removal of the part or item to be repaired or replaced. Because of its relatively small size, the device can be readily used in confined areas.

Reference will now be made to the drawings, where like numbers represent the same element.

The device of the invention includes a vertical piece, 2, constructed of a suitable material (preferably steel). One end of the vertical piece is adapted to fit into a receiver, 3, which is attached (such as by welding) to the base of the machinery, 4, which includes the item or part, 5, to be removed and repaired or replaced. As shown, the lower end of the vertical piece is preferably provided with a collar, 12, which rests on the receiver.

The receiver, 4, allows the vertical piece to rotate as shown by arrow A in the drawings.

The other end of the vertical piece, 2, is attached (such as by welding) to a generally horizontal, hollow pipe, 6, which is curved downwardly at both ends. This pipe also is preferably constructed of steel. In the embodiment shown in the drawings, the hollow pipe is shown as consisting of two separate hollow pipes, 6A and 6B. As shown, the outside diameter of the inner pipe, 6A, is smaller than the inside diameter of the outer pipe, 6B, so that the total length of the horizontal pipe can be varied. Obviously, where such a configuration is used, attachment bolting means 7 are provided so that when in use, the horizontal pipe can not be expanded or reduced in length.

Figure 2:
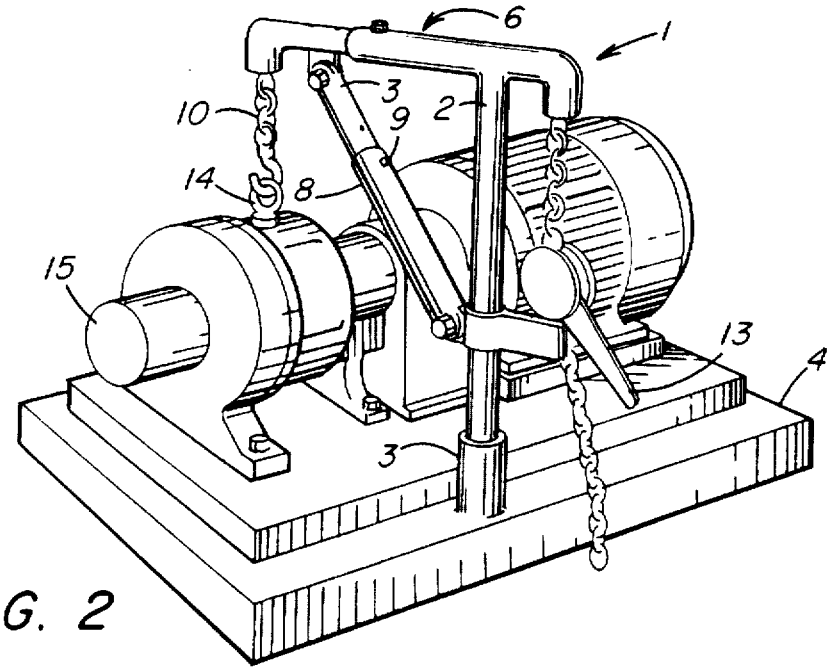
FIG. 2 shows how the device of the invention operates.
Figure 3:
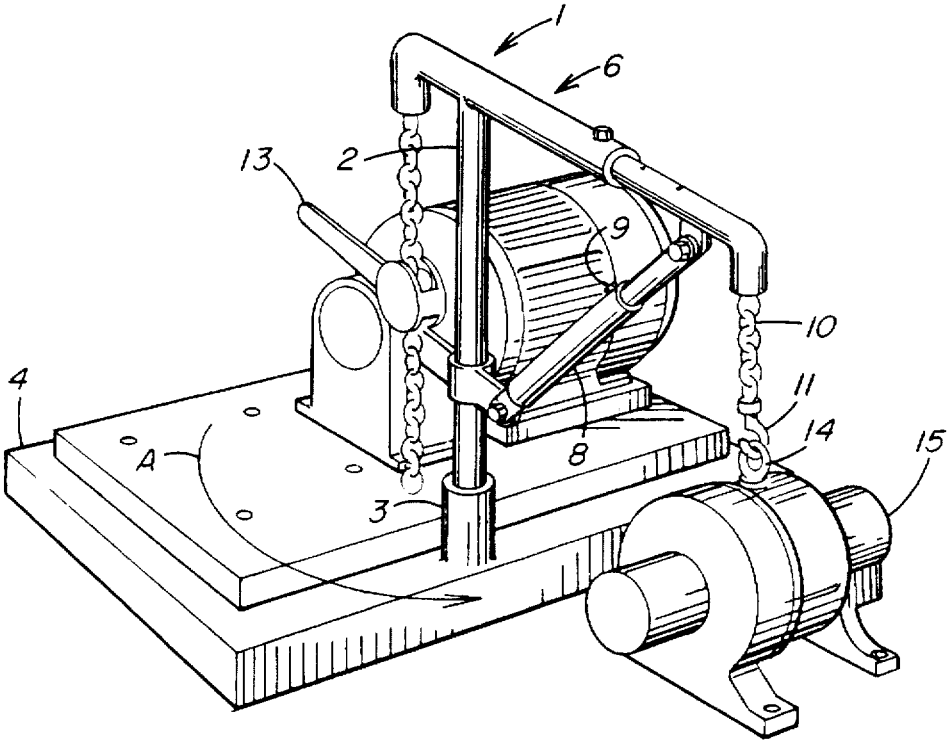
FIG. 3 shows how the device of the invention operates.

A brace, 8, is attached to both the vertical piece, 2, and the horizontal pipe, 6. This brace also is preferably constructed of steel. In the embodiment shown in the drawings, the brace is shown as consisting two separate hollow pipes, 8A and 8B. As shown, the outside diameter of the inner pipe, 8A, is smaller than the inside diameter of the outer pipe, 8B, so that the total length of the horizontal pipe can be varied depending upon the length of the horizontal pipe. Obviously, where such a configuration is used, attachment bolting means 9 (see FIGS. 2 and 3) are provided so that when in use, the brace will not be expanded or reduced in length.

A chain, 10, runs through the horizontal pipe. At one end of the chain, a hook, 11, (or other suitable gripping means) is attached, while at the other end a ratcheting device, 13 (such as a ¾ton "come-a-long").

In operation, the vertical piece is placed in the receiver. A ring, 14, is provided on the piece to be lifted and the hook, 11, is passed through the ring. The ratcheting device is then moved up and down to lift the part, 15, and the device is rotated about its axis. The part, 15, can then be lowered onto an appropriate transporting means (such as a cart), the hook disengaged and the part, 15, moved to the site for disposal or repair.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A device for lifting heavy items from machinery in confined areas comprising:

(a) a rigid vertical piece, one end of which is adapted to removably fit into a receiver attached to said machinery;

(b) a generally horizontal, hollow pipe attached to the other end of said vertical piece, wherein said horizontal, hollow pipe comprises an inner and outer horizontal hollow pipe, said outside diameter of said inner horizontal pipe is less than the inside diameter of said outer horizontal hollow pipe such that the total length of said horizontal, hollow pipe can be varied by moving said outer horizontal hollow pipe, said pipe being curved downwardly at both ends, said other end of said vertical piece being attached to said hollow pipe between said ends of said hollow pipe, (c) an adjustable brace supporting said pipe, said adjustable brace connected to said outer horizontal hollow pipe and to said vertical piece, and (d) a chain running through said pipe, said chain having a hook at one end and a ratcheting device at the other end, said ratcheting device being used to generate the force necessary to lift said heavy items.

2. A device according to claim 1, wherein said brace comprises an inner and outer hollow pipe, said outside diameter of said inner hollow pipe is less than the inside diameter of said outer hollow pipe such that the length of said brace can be varied as said length of said horizontal, hollow pipe is varied.

* * * * *